US006874786B2

(12) United States Patent
Bruno et al.

(10) Patent No.: US 6,874,786 B2
(45) Date of Patent: Apr. 5, 2005

(54) BLACKJACK GAME WITH SIDE WAGER ON DISPLAYED CARDS

(75) Inventors: Anthony J. Bruno, Henderson, NV (US); Weldon L. Russell, III, Las Vegas, NV (US)

(73) Assignee: Shuffle Master, Inc., Las Vagas, NV (US)

( * ) Notice: Subject to any disclaimer, the term of this patent is extended or adjusted under 35 U.S.C. 154(b) by 0 days.

(21) Appl. No.: 10/622,391

(22) Filed: Jul. 17, 2003

(65) Prior Publication Data

US 2005/0012273 A1 Jan. 20, 2005

(51) Int. Cl.[7] ..... A63F 1/00

(52) U.S. Cl. ..... 273/306; 273/304; 273/292; 463/12

(58) Field of Search ..... 273/292, 303–306, 273/274, 309; 463/12

(56) References Cited

U.S. PATENT DOCUMENTS

| | | | | |
|---|---|---|---|---|
| 4,861,041 A | | 8/1989 | Jones et al. | |
| 5,013,049 A | | 5/1991 | Tomaszewski | |
| 5,098,107 A | * | 3/1992 | Boylan et al. | 273/292 |
| 5,174,579 A | | 12/1992 | Griffiths | |
| 5,257,784 A | | 11/1993 | Boylan et al. | |
| 5,275,416 A | | 1/1994 | Schorr et al. | |
| 5,288,077 A | | 2/1994 | Jones | |
| 5,364,105 A | | 11/1994 | Jones | |
| 5,374,067 A | | 12/1994 | Jones | |
| 5,377,993 A | | 1/1995 | Josephs | |
| 5,454,570 A | | 10/1995 | Karal | |
| 5,538,252 A | | 7/1996 | Green | |
| 5,653,444 A | * | 8/1997 | Dahl | 273/274 |
| 5,673,917 A | | 10/1997 | Vancura | |
| 5,816,575 A | | 10/1998 | Keller | |
| 5,829,750 A | | 11/1998 | Booker | |
| 5,839,730 A | | 11/1998 | Pike | |
| 6,000,699 A | | 12/1999 | Long | |
| 6,012,719 A | | 1/2000 | Webb | |
| 6,095,525 A | | 8/2000 | Terminel | |
| 6,206,375 B1 | | 3/2001 | Wichinsky | |
| 6,341,778 B1 | | 1/2002 | Lee | |

OTHER PUBLICATIONS

Ten Stix, Inc., "Ten Stix 21" brochure, World Gaming Congress, Oct. 1997.*

Over/Under 13 Blackjack, Gaming Concepts, Inc., 1988.

* cited by examiner

*Primary Examiner*—Benjamin Layno

(74) *Attorney, Agent, or Firm*—Mark A. Litman & Associates, P.A.

(57) ABSTRACT

An underlying game of Blackjack or a variant of Blackjack is played with an initial wager by a player on the underlying game and an optional wager on a side game can be made. The side wager is made before any cards are displayed. Specially marked cards with count values replace standard cards having the same count value and the side wager is paid on the appearance of the specially marked cards in the play of the game. The number of specially marked cards may vary over time.

28 Claims, No Drawings

BLACKJACK GAME WITH SIDE WAGER ON DISPLAYED CARDS

BACKGROUND OF THE INVENTION

1. Field of the Invention

The present invention relates to card games, particularly to blackjack card games and its variants and more particularly to an underlying Blackjack card games and variants with side bets on events that substantially do not influence the underlying strategies in the play of the underlying Blackjack game.

2. Background of the Art

Card games have always been popular as wagering games. The history of card games reaches back into biblical eras. One of the most popular card games, especially for gambling or gaming uses is the card game known as Blackjack (or "21") wherein a blackjack player plays against a dealer and the object is to beat the dealer's hand by reaching a total point value closest to 21, without exceeding a point count of twenty-one and/or by having the dealer's point count exceed twenty-one. The player may exercise strategies including adjusting his point count either by maintaining his original cards and card count (e.g., referred to as "standing," not drawing a card that might cause the Blackjack player to 'bust' that is go over 21) and hope that the dealer will bust or by accepting additional cards (referred to as 'hitting' or 'taking a hit'), attempting to receive a cumulative point card total higher (not exceeding a total point count of 21) than the total point count that the Dealer will ultimately attain. If both the Blackjack player and the dealer each achieve a point count total that does not exceed 21, then the highest total (as between individual players and the dealer) wins the bet. Blackjack is relatively simple to understand and is usually a faster and easier card game to play than, for example, the game of Poker, therefore Blackjack, which can be played with the dealer and only one Blackjack player, tends to be more popular than the conventional game of Poker which needs to be played with several players because each of the Poker players are competing against each other for one pot whereas each Blackjack player can win against the one dealer. Even with variants of poker being played in casinos (e.g., Let It Ride® poker, Three Card Poker®, Crazy 4 Poker™, Caribbean Stud® poker, etc.), Blackjack remains the most popular card game in casinos, with many more tables usually dedicated to blackjack than to all other card games combined.

Blackjack must include a dealer (in mechanical, electromechanical, electronic or video versions of the game, a virtual dealer's hand is provided) and there must be at least one Blackjack player. One or more Blackjack players playing against the Dealer are, in effect, individually competing to try to either obtain a better total card point count than the point count of the dealer, without exceeding a total point count in the player's hand of 21 (for the total number of multiple playing cards that they the dealer is dealt). The player may stand after receiving a minimum of 2 cards and hope that the Dealer will bust. There are many variants on strategies that are used in the play of cards that are dependent upon a consideration of the player's cards in comparison with the dealer's cards. There are preferred and optimal strategies that may be used, with some strategies possibly influenced by card counting by the player.

For example, Blackjack players seeing a dealer's exposed card as a 2, 3, 4, 5 or 6, will themselves elect to take no hits when the player's point count is 12, 13, 14, 15 or 16 in the hopes that the dealer's hitting (which is required when the dealer's point count is 16 or less) will result in a bust. The objective of the player is that with the exposed card being generally incapable of having a starting point count where the dealer may stand (the exception being a disclosed card of a 6 and a hole card of an ace), the dealer will take hits to a point total that exceeds 21 and therefore break (or "bust"), allowing the player to win the hand. The player will win the bet if the dealer has to hit (the Dealer is required to draw if their point total is 16 or less) and the Dealer busts (goes over 21). Blackjack players also have the option of splitting any pairs (i.e., a pair of cards of identical point count value, such as two face cards, a 10 and a face card, a pair of 10s, a pair of 9s, a pair of 3's, etc.). Blackjack players have several options such as to double down (double their bet and receive only one more card), double their bet when they split a pair of cards, and can receive a 1.5 times their bet return if they receive an Ace and a 10 or picture card for their other card. A Blackjack player receiving a card score of more than 21 points has a bust hand and automatically loses to the dealer. If the dealer accumulates cards with a point count in excess of 21, the dealer busts, and every player remaining in the game (those players who have not busted themselves) wins the hand. The dealer, after receiving the first 2 cards begins drawing one or more cards (if the first 2 cards are 16 or less), but only after each of the Blackjack players at the dealer's table have played their hands to completion. Therefore, the house or casino has the advantage because the Blackjack player or players must play and complete their hand first or before the dealer plays or completes his hand. The Blackjack players at the table individually play against the dealer. The dealer must receive a minimum of 2 cards and attain a point count of at least 17 before the dealer may stop taking cards. Each of the Blackjack players individually playing against the dealer (who is a representative of the house or casino) has the option of standing after the receipt of their 2 initial cards. This means that the player will have the option of not receiving any other cards or to draw one or more other cards from the dealer and to continue drawing cards until the player is either satisfied with their card count score and stops drawing cards (stands) or the player has busted (gone over the 21 point total). As is known in the Blackjack card game, picture cards (Jacks, Queens and Kings) each have a point card value of 10 points while Aces have a point card value of either 1 point or 11 points. The other cards namely 2s, 3s, 4s, 5s, 6s, 7s, 8s, 9s and 10s have a point card value equivalent to their face card value (i.e., respectively 2, 3, 4, 5, 6, 7, 8, 9, and 10). In most gaming or casino establishments, dealers have to draw when they receive a point card value of 16 or less and, in some Casinos or gaming establishments, when they receive a point card value of 17 or less where the 17 point card value is based upon using an Ace as an 11 point card value with one or more other cards (this is known as a soft 17).

While Blackjack or 21 is a relatively fast-playing card game, it is always desirable to offer the players opportunities for variations in the game to maintain their long-term interest. Other betting options are desirable for the Blackjack player other than just varying the size of their wagers. Thus a Blackjack game is needed which would permit the Blackjack player to have a chance to win a large bet (as a regular option or an option after losing a number of conventional bets to the dealer) without the risk of losing a large bet that was the only previous option to try to promptly recoup a series of lost bets to the Dealer.

Attempts have been made to vary the game of Blackjack to a relatively minor degree wherein a Blackjack player could have more than one betting option other than the Blackjack player's bet to receive a higher card total not more than the maximum of 21 than the Dealer or to hope that the Dealer busts. However, these other attempts have not been successful because they do not provide a multitude of very exciting betting options combined with a large jackpot type of payout. U.S. Pat. No. 5,454,570 to Karal discloses a Blackjack card game method therein a Blackjack player has extended wagering opportunities after the Blackjack player's hand has reached a desired card count value. Specifically, the Blackjack player can bet on whether the Dealer will achieve a card count that would be higher (but not greater than 21) than the Blackjack player's hand. This supplemental bet or wager by the Blackjack player is prior to the Dealer revealing the Dealer's face down card. Predetermined odds on the different possible Dealer hand combinations are selected by the Blackjack player by the selection of the point card value of the Dealer's hand. Also, the Blackjack player can wager on the point card value of the Dealer's only face down card. Furthermore, the Blackjack player can bet on the point card value of the third Dealer card, etc. The odds presented in this U.S. Patent range from 10 to 1 (on an Ace being the Dealer down card or the next card to be drawn by the Dealer). Picture cards including 10's have a 2 to 1 betting ratio.

U.S. Pat. No. 5,275,416 (Schorr et al.) discloses a Blackjack card game method wherein a Blackjack player can bet on the Dealer's hand, the Blackjack player's hand or for a tie in the point count between the Dealer and the Blackjack player. The bet for the tie pays 9 to 1, the bet for the Blackjack player's hand pays even money (1 for 1), and the bet on the Dealer's hand pays 5 for 6 (five chips can be won on a 6 chip bet).

U.S. Pat. No. 5,174,579 (Griffiths) discloses a Blackjack card game method wherein a separate bet can be made on whether the dealer obtains exactly 21 or busts. Disclosed therein is a discussion of Royal Match 21 involving a separate bet by the Blackjack player to have their 2 initial cards be of the same suit (i.e. clubs, diamonds, hearts and spades). A higher payout is awarded for when the Ace and King is received by the Blackjack player in the same suit for the 2 initial cards, but there is no specific separate bet for the receipt of these two cards (only a payout if they happen to be received when a bet is made for the receipt of 2 initial cards of the same suit). Also disclosed therein is a reference to the U.S. Pat. No. 4,861,041 to Jones et al. wherein a separate bet on a blackjack game is made to be eligible for certain specific jackpot hands (i.e., four 5s and an Ace or Ace, Two, Three, Four, Five and Six). Simply stated, prior attempts at providing more than one betting option to the Blackjack player did not give the Blackjack player an opportunity to bet and win a very large bonus (i.e. more than a thousand chips for each chip bet) as well as to bet on many different possible combinations that would pay more than a one chip payback for each one chip bet, but yet still provide the Blackjack player with, if desired, a straight bet to beat the dealer.

U.S. Pat. No. 5,816,575 describes a variant of Blackjack (21) game, in which a table and method is disclosed wherein a number of betting options are provided for the Blackjack player. In addition to the standard betting option against the dealer, a dealer Bust option, a jackpot option where the Blackjack player can obtain over 1,000 to 1 return payout and several other betting options are provided to bet on various possible cards such as receiving a 3 or a 6, a 4 or 5, a 10, Jack Queen, King or Ace for one or both of the initial two cards. The method of playing Blackjack against a dealer comprises the steps of providing a Blackjack player with a jackpot betting option to make a bet and have a possibility of winning more than one thousand times the bet made by the Blackjack player; and providing the Blackjack player with additional separate betting options to make a bet on receiving at least one card from an initial two cards received by the Blackjack player equal to one of a 4 and 5, one of a 3 and 6 and a selected one of a 10, a Jack, a Queen, a King and an Ace.

U.S. Pat. No. 5,839,730 (Pike) describes a method for a wagering game that is achieved by providing a side bet opportunity during the play of a Twenty-One game. The player is given the opportunity to place this side bet with the hope of receiving winnings when certain predetermined card configurations are received. Upon receipt of these defined card configurations, the player is immediately paid winnings during the process of the Twenty-One game. These additional winnings are based on sequences of cards and are independent and separate from wagers in the Twenty-One game. Additionally, all of the predetermined card configurations are preferably chosen such that they will not interfere with the underlying Twenty-One game. As a basis for paying out winnings, it is required that the player consecutively receive these certain card configurations during the play of the Twenty-One game after having made a bet in expectation of those card configurations appearing. Also, the final configuration of the Twenty-One hand is irrelevant to the side bet game as the players win immediately when the predetermined configurations are received, long before completion of the hand. In particular, the player's receiving of identical value cards in sequence is awarded bonus amounts when a side wager is placed.

U.S. Pat. No. 6,012,719 describes a card game that combines the play of Blackjack ("21") with a 3-card Poker wager or side bet ("21+3"). Each player places a basic Blackjack wager and an optional 3-card Poker wager before the cards are dealt. Each player is then dealt a card with the dealer receiving a face-up card. Each player is dealt a second card. At this point, the outcome of each 3-card Poker hand is determined, where a player's 3-card Poker hand consists of the 2-card hand dealt to that player and the dealer's face-up card. After settling the Poker wagers, the game of Blackjack continues in a typical fashion. The invention advantageously retains all the features and advantages of Blackjack as well as provides the dynamics of 3-Card Poker, without interfering with the card sequence, for enhanced player anticipation and enjoyment.

U.S. Pat. No. 6,000,699 (Long) describes a method of playing the card game of twenty-one or Black Jack involving a variation which allows a player to place a side wager in addition to the initial wager or ante, wherein the side wager allows the player to win at least a portion of a supplemental payout, which may be a predetermined amount or be derived from a progressively increasing wager pool, if one or more hands of the player have a final number count which ties the final number count of the dealer's hand. The player has the opportunity to concurrently play additional hands, each of which may also be eligible to participate in at least a portion of the supplemental payout if any one or all of the additional hands have a final number count equal to the final number count of the dealer hands. The player's additional hands are created by "splitting" initial and successive cards dealt the player if such cards are the same numerical count.

U.S. Pat. No. 5,829,750 (Booker) describes a method of playing a card game of 21 or Black Jack which allows wagers on the occurrence of a Black Jack within certain categories of Black Jacks, the categories being defined by ranks and suits. A number of possible single hand and multi-hand categories of Black Jacks are defined. A player must place a wager on the occurrence of a Black Jack within one or more specified categories during the course of a standard game of Black Jack. If a specified hand or specified hands have a Black Jack which falls within the specified category, the player will win the wager according to a predetermined payout ratio. Bonuses may also be paid for certain categories.

U.S. Pat. No. 5,816,575 (Keller) describes a method of playing Blackjack against a Dealer comprising the step of: providing a Blackjack player with a jackpot betting option to make a bet and have a possibility of winning more than one thousand times the bet made by the Blackjack player; and providing the Blackjack player with additional separate betting options to make a bet on receiving at least one card from an initial two cards received by the Blackjack player equal to one of a 4 and 5, one of a 3 and 6 and a selected one of a 10, a Jack, a Queen, a King and an Ace.

U.S. Pat. No. 5,673,917 (Vancura) describes a side wager to the game of blackjack or Twenty-One. This side wager allows players to wager on the number of hits that they and/or the dealer will ultimately take. The resolution of the main wager can proceed in the usual fashion, and the game is robust in that it can accommodate common rules variations among casinos. Unlike existing blackjack side wagers, players are actively in control of their fortunes and can play hands as they wish. This added feature affords players considerable excitement and interest, and mathematically, makes the main and side wagers dependent on each other. The game can be played on a standard blackjack playing surface with additional delineated areas for making the side bet.

U.S. Pat. No. 6,341,778 (Lee) describes a method for increasing the payout for the main wager of the game of blackjack or Twenty-One and/or for providing a side bet opportunity during the game of blackjack or Twenty-One which are based upon the point-spread between the players hand and the dealers hand. In one embodiment, a pointspread of 1, 2, 3, or 4 would result in 1 times, 1.5 times, 2 times, or 10 times, payout, respectively, of the side wager. In another embodiment, a pointspread of 1, 2, 3, or 4 would result in 1 times, 2 times, 3 times, or 5 times, payout, respectively, of a side bet. In another embodiment, a pointspread of 0, 1, 2, 3, or 4 would result in 0.5 times, 1 times, 1.5 times, 3 times, or 5 times payout, respectively, of a side bet. The game allows for variations in the rules and for other types of side-betting opportunities while maintaining the excitement of a multiple pointspread payout at the resolution of the hand.

U.S. Pat. No. 6,206,375 (Wichinsky) describes a blackjack table card game and method is disclosed which permits each player betting against a dealer several betting options by placing one or more chips in one or more separate betting regions located in front of each player. One of these betting regions permits a player to bet that the player will receive a two-card blackjack consisting of one card having a value of nine, ten, eleven or twelve and the other card having a corresponding respective value of twelve, eleven, ten or nine in any two card sequence. Preferably 60 playing cards are used consisting of a standard deck of 52 playing cards and eight additional playing cards which consist of four different suited but standard suited playing cards each having a value of 11 and four different playing cards each having a value of 12.

Over-Under 13 is a side bet game in which a player may place an "over 13" or an "under 13" side bet on a blackjack hand. The player may bet that the player will have an initial two card hand under or over the point count of 13. This side bet game is widely used in casinos in the United States.

Other publicly displayed side bet wagering games related to Blackjack include Single 21™ blackjack game (described in copending U.S. patent application Ser. No. 10/199,561, titled Split Card feature During Continued Play of Blackjack) and JackMagic™ blackjack game (described in U.S. patent application Ser. No. 10/272,407 titled Blackjack Game with Single Wager on Displayed Cards).

D.E.Q. Casinos, Ltd. markets a game known as "Luck Jacks & Queens™" which is played in conjunction with a side bet in a standard blackjack game. Regular blackjack rules apply, and an optional side bet for the side game is made. Combinations of a Jack and a Queen on the first two cards wins a randomly selected prize amount. Suited Queen and Jack combinations on the first two cards can win multiples of the randomly selected prize amounts. The random amount is selected and displayed on a meter attached to the table. There is no pay table.

In spite of the success of some of these card games, there is always a need to provide additional alternative for players.

SUMMARY OF THE INVENTION

An underlying game of cards (preferably Blackjack (Twenty-One) or Blackjack variant, although stud poker or even baccarat is an option) is played with a modified deck(s) of cards. In the deck(s) of cards, certain cards are replaced by special cards that have unique game identification on those replacement cards. The cards that have been replaced are replaced with cards having essentially the same value(s) as the cards that have been replaced. In this way, the probabilities of card play in the underlying game are not altered. When a player makes a side bet on a bonus event in the underlying game, the appearance of the special card(s) provides an award to the player making the side bet. The greater number of special cards that appear in a hand, the potentially greater size of an award for players who have placed the side bet.

In special events or occasions (e.g., casino openings, casino expansions, special weekends, special events, etc.) the number of special cards may be altered over time and the awards varied for side bet payouts.

DETAILED DESCRIPTION OF THE INVENTION

An underlying game of Blackjack, a variant of Blackjack or other casino-style card game is played with an initial wager by a player on the underlying game. An optional wager on a separately paying side game can be made. The side wager is made before any cards are displayed (especially in the players' hands, although disclosure of a card first in the dealer's hand would not as greatly affect play of the side bet game). When the underlying game is Twenty-One, in one example of the invention, the separately paying game does not ordinarily interfere with any underlying strategy in the play of the underlying game or the payout on the underlying game, although at least one circumstance would be considered less then optimum strategy. (This would be where the first two player cards include a special card and also exceed a count of eleven and the count is less then seventeen, and the dealer's up card is a 2, 3, 4, 5 or 6).

In a second example of the invention, the first two player cards and the dealer's up card are used to evaluate the side bet. In no instance would this method of determining the side bet affect the strategy in the underlying game. After placement of the ordinary blackjack wager and the optional side bet wager, two cards are provided to the player (face up) and two cards are provided to the dealer, one of which is face up, or any other traditional variation on the display of cards in Twenty-One or Blackjack. The play of the hand continues in its normal fashion through conclusion of the hand.

The side bet in the first example is resolved after the blackjack hands are resolved. The side bet in the second example may be resolved before any additional cards are dealt and/or after the blackjack hands are resolved. Prior to the first deal out of a shoe or a continuous shuffler, a number of cards (possibly of the same rank or at least a combination of three cards whose rank does not exceed twenty-one) are replaced in the deck. The cards (typically the preferred method replaces sevens) that are removed are replaced with special suited cards or specially identified cards of the same value as the cards replaced. It is possible, for terms of patentability, that cards of different values may replace the removed cards, but the replacement cards preferably have a value such that the cards would not generally affect player strategy. A player is paid a sum certain amount, independent of the play wager (or alternatively may be paid a multiple of the wager in a less preferred variant) on the occurrence of specific hands:

a) a hand (consisting of player and/or dealer cards) with one of the specially "suited" or "symboled" cards of normal rank;

b) a hand with two of the specially "suited" or "symboled" cards of normal rank; and c) a hand with three of the specially "suited" or "symboled" cards of normal rank.

d) The payout for the side bet game is paid at the conclusion of dealing the first two cards to each position at the table or at the conclusion of playing out the hands.

In one example of the invention, only player cards are used to evaluate the side bet outcomes. In a second, more preferred example of the invention, the player's two cards and the dealer's up card are used to evaluate each player's side bet outcome. In the second example, the dealer's up card becomes a community card for purposes of evaluating the side beat. With a SPECIAL card appearing as the dealer's up card, every player with a side bet would win at least the minimum return on the side bet wager for the appearance of a SPECIAL card.

The specially suited or symboled card (e.g., the card may still be a Heart, but having the Heart adorned with the casino name, or the name of the event ($4^{th}$ of July Extravaganza, etc.) may be any value card in the deck wherein maximum bonuses for the maximum number of SPECIAL cards in a hand are hands that are still in play in the game (e.g., do not exceed a count of 21 in Blackjack), but is preferably chosen in Blackjack with counts of Seven, although counts of 6 are possible, with counts of 5 or 4 being less likely or desirable. Counts below 6 can alter the play of the game and are therefore less desirable, as players might elect to take disadvantageous hits in the game of Twenty-One while trying to get more special cards. With counts of the SPECIAL cards at 7 or 6, the maximum number of special cards possible in a hand are three cards and this places the odds and probabilities at a desired level. Even with the SPECIAL card value at 6, undesirable play variations, such as hitting with soft 17's could affect play of the game in an undesirable manner.

As implied in this discussion, there are different levels of payout amounts depending upon how many special "suited" cards appear in a hand (that may or may not include one or more dealer cards). Once the side bet has been made, the dealer reviews each player's hand to see if SPECIAL cards are present and determine if side bet wagers are to be paid. It is also contemplated that the side bet wagers paid when some bonus hands appear entirely in the dealer's hand and side bets have been placed. The payout for appearance of the SPECIAL cards in the dealer's hand would be for amounts less then those in the player's hand and should be paid only to players with the side bet wagers.

For example, with seven players at a table and three players having made the side bet, the payout for the dealer's Special cards could be:

| | |
|---|---|
| One SPECIAL card | At least $1 or at least 1× side bet for each player with side bet |
| Two SPECIAL cards | At least $2 or at least 2× side bet for each player with side bet |
| Three SPECIAL cards | At least $5 or at least 5× side bet for each player with side bet |

The payout amounts may be greater, especially with 2 or 3 SPECIAL cards in the dealer's hand, up to fractions of the bonus for those cards appearing in the player's hands. For example, if there were a $50,000 bonus for three SPECIAL cards in a player's hand, with three players making the side bet and the dealer showing the three SPECIAL cards, each player placing the side bet could get 1/3, 1/4, 1/5, 1/6 . . . 1/10 of the bonus amount. Similar reduced proportions could be awarded on the appearance of two SPECIAL CARDS in the dealer's hand.

An example of the paytables for appearance of SPECIAL cards being counts of Seven with sevens (of any or various suits) removed and replaced with Fifth-Suited or Symboled 7's (specially marked sevens that have indicators as bonus cards, yet still have a rank of seven or count of seven in the underlying game) would be as follows, with different phases or stages of the game shown to increase player interest:

In a first phase of the game or promotion, three special 7's replace three sevens in the group of cards (usually multiple decks, such as at least two decks, preferably at least four decks, at least six decks or at least eight decks in the group of cards). Any three sevens of any of the original four suits may be removed. The following pay table for the first phase of the promotion will provide the house with a 16.8% house advantage:

| HAND | PAYOUT |
|---|---|
| 3 SPECIAL 7's | 50,000 |
| 2 SPECIAL 7's | 500 |
| 1 SPECIAL 7 | 20 |

In a second phase of the promotion, four Fifth-Suited 7's will be added to the decks, and a fourth 7 of one of the original four suits will be removed. The following pay table will provide the house with a 21.02% advantage:

| HAND | PAYOUT |
|---|---|
| 3 SPECIAL 7's | 50,000 |
| 2 SPECIAL 7's | 500 |
| 1 SPECIAL 7 | 10 |

In a third phase of the promotion, five Fifth-Suited 7's will be added to the deck. The following pay table will provide the house with a 9.95% house advantage:

| HAND | PAYOUT |
|---|---|
| 3 SPECIAL 7's | 50,000 |
| 2 SPECIAL 7's | 500 |
| 1 SPECIAL 7 | 5 |

Further or Alternative Game Descriptions

The game is a multiple deck Blackjack or Twenty-One variant game played with 4, 5, 6 or 8 decks of cards. The game can be dealt out of a card dealing shoe or out of an automatic card shuffler. If the game utilizes a shuffler, the KING™ 5 shuffler (using 5 decks) would most likely be the shuffler that is used. The base game is Blackjack, with no variations in the underlying rules. The game could be first introduced at SPECIAL Casino, with specially marked/printed cards identifying the specific casino.

The casino will provide a side bet system (bet sensors and a keypad) that will keep track of the number of side wagers placed, and will lock out late betting. The keypad will communicate with a host computer system provided by the casino. There will be no progressive meter, just a plasma, LED or LCD display that displays the appropriate pay table for the phase of the promotion.

Players have the option of placing an optional side bet to win a jackpot prize for being dealt one or more special 7's. The winning combination and associated prizes are posted on a pay table. Specific payouts are different depending upon the phase of play of the game. The pay table may be posted on an electronic display board.

The promotion includes removing three regular sevens from the group of cards, and replacing those three cards with three SPECIAL 7's. (Per group if multiple decks of cards are in the group of cards being used, or per shoe) Although the probability of occurrence of combinations including 7 cards will not change, adding a $5^{th}$ suit to the deck will alter the probability of occurrence of winning suited combinations in the base game. For this reason, it is preferable to choose a base game whose winning outcomes depend only upon card count, and not card suit, so that the underlying game mathematics does not change. A preferable game is blackjack, although baccarat is an optional alternative.

Adding a separate suit of 7's decreases the probability of occurrence of strings of the fifth suit (as compared to 7's of the first four suits), and allows for larger prizes. The "hand" of a player will be each individual hand (a split hand is two hands). If a player wants all split hands to be involved in the side bet game, the house may either require additional side bets for each split hand or grandfather in split hands so that a single initial wager will be treated as sufficient to include all split hands.

In the first phase of the promotion, three special 7's will replace three sevens in the group of cards. Any three sevens of any of the original four suits may be removed. The following pay table for the first phase of the promotion will provide the house with a 16.8% house advantage:

| HAND | PAYOUT |
|---|---|
| 3 SPECIAL 7's | 50,000 |
| 2 SPECIAL 7's | 500 |
| 1 SPECIAL 7 | 20 |

In the second phase of the promotion, four SPECIAL 7's will be added to the deck, and a fourth 7 of one of the original four suits will be removed. The following pay table will provide the house with a 21.02% advantage:

| HAND | PAYOUT |
|---|---|
| 3 SPECIAL 7's | 50,000 |
| 2 SPECIAL 7's | 500 |
| 1 SPECIAL 7 | 10 |

In the third phase of the promotion, five SPECIAL 7's will be added to the deck. The following pay table will provide the house with a 9.95% house advantage:

| HAND | PAYOUT |
|---|---|
| 3 SPECIAL 7's | 50,000 |
| 2 SPECIAL 7's | 500 |
| 1 SPECIAL 7 | 5 |

It is possible to allow the various stages to continue for specific periods of times. For example, it would be likely to let the first two phases go on for a month each, and estimates based on probabilities are that the top award will hit in the third stage within the first week.

The following description will assist in illustrating one method of playing the game of the invention.

In the above description, variations within the generic concept of the invention have been alluded to or described. One of ordinary skill in the art can develop other alternatives or additions within the scope of the invention. For example, special wagering features such as coin accepting slots, proximity detectors, or other wager indicators (particularly for the side bet wager) can be provided on the gaming table for the play of the side bet bonus Blackjack game. Progressive bonuses may be designed for use with the appearance of the maximum special hands. Such a progressive bonus may be indicated on a special meter. Other options and components may be added to the play of the game without avoiding the underlying generic concepts disclosed in this description and the claims of the invention.

For example, the underlying game could be another casino-style card game such as baccarat, pai gow poker, or a specialty poker game such as Let it Ride® Stud Poker, for example. In the case of Let it Ride® poker, players each receive 3 cards, face down after placing three equal bets. The dealer receives two cards, face down, that serve as common cards for all players. The players are given a chance to view their cards, and are given the option of taking back one of the bets. The dealer turns over the first community card, and the players are then given the opportunity to take back a second one of the bets. The third bet must remain up. The dealer then reveals his second community card, and each player's hand of three cards plus the two community cards is resolved against a pay table. The pay table shows payout odds for each of a predetermined group of winning hands. A side bet of the present invention could be made available for the appearance of one, two or three SPECIAL cards from the player hand, the dealer common cards or a combination thereof. It is preferred that the layout be modified so that the player's three cards appear on a given area of the layout, and that the order in which the cards are dealt cannot be modified. In this example, as the suit of the card is a criterion in determining game outcomes, special cards are assigned two suits—the original suit of the removed card and a special suit/symbol designation for the side bet.

In another example, the underlying game is Pai Gow poker. Each player and the dealer receive 7 cards. The players and the dealer "set" their hands, forming a five card hand and a two card hand. A side bet on the occurrence of a SPECIAL designated card could be offered. Or, the designated card may be in a Dragon hand as the side bet wager, or combinations of the five and two card hands. Other casino games such as Baccarat could be played in a manner similar to the blackjack game described in detail above. Baccarat is a particularly good choice because the game outcomes do not involve the suit of cards played. A fifth suit could be used to directly replace cards of the standard four suits without affecting game outcomes.

What is claimed:

1. A method of playing a wagering card game comprising an underlying card game and an auxiliary card game comprising:

providing a standard set of cards in which some cards, but less than all cards, of at least one certain count value are replaced with replacement cards of equal count value, but the replacement cards have identifying markings that differentiate replacement cards from standard spades, hearts, diamonds and clubs suits;

placing at least one wager on the underlying card game;

optionally placing a wager on the auxiliary card game;

dealing a first number of cards to a player;

dealing cards as needed in the play of the player's hand, in common cards, the dealer's hand or combinations thereof to complete the underlying card game;

displaying all of the player's cards;

wherein if at least one of the displayed player's cards is a replacement card, paying a player who has placed the optional wager for the presence of the at least one replacement card in either the player's hand or the dealer's hand; and paying a player according to the rules of the underlying game.

2. The method of claim 1 wherein the count of cards is fundamental and suit appearance is fundamentally unimportant in the play of the underlying game.

3. The method of claim 1 wherein a second number of cards is dealt to the dealer as part of the underlying game.

4. The method of claim 1 wherein the optional wager is for the presence of the at least one replacement card in the player's and/or dealer's hand.

5. A method of playing a wagering card game comprising an underlying card game and an auxiliary card game comprising:

providing a standard set of cards in which some cards, but less than all cards, of at least one certain count value are replaced with replacement cards of equal count value, but the replacement cards have identifying markings that differentiate replacement cards from standard spades, hearts, diamonds and clubs suits;

placing at least one wager on the underlying card game;

optionally placing a wager on the auxiliary card game;

dealing a first number of cards to a player;

dealing cards as needed in the play of the player's hand, in common cards, the dealer's hand or combinations thereof to complete the underlying card game;

displaying all of the player's cards;

wherein if at least one of the displayed player's cards is a replacement card, paying a player who has placed the optional wager for the presence of the at least one replacement card in either the player's hand or the dealer's hand; and paying a player according to the rules of the underlying game, wherein the underlying game is a variant of Blackjack.

6. The method of claim 5 wherein only one single value of card count is replaced with replacement cards.

7. The method of claim 5 wherein at least three sevens are replaced with replacement cards and the optional wager pays for the presence of 1, 2 or 3 sevens being present in a hand with a total count of twenty-one or less.

8. The method of claim 7 wherein the optional wager is for the presence of the at least one replacement card in the player's and/or dealer's hand.

9. The method of claim 5 wherein awards are provided to players making side bet wagers when a dealers hand has at least one replacement card present.

10. The method of claim 5 wherein a paytable for side bet payouts on replacement cards appearing in a player's hand comprises:

| | |
|---|---|
| 3 SPECIAL 7's | at least $20,000 |
| 2 SPECIAL 7's | at least $500 |
| 1 SPECIAL 7 | at least $5. |

11. The method of claim 10 wherein the optional wager is for the presence of the at least one replacement card in the player's and/or dealer's hand.

12. The method of claim 5 wherein the optional wager is for the presence of the at least one replacement card in the player's and/or dealer's hand.

13. A method of playing a wagering card game comprising an underlying card game and an auxiliary card game comprising:

providing a standard set of cards in which some cards, but less than all cards, of at least one certain count value are replaced with replacement cards of equal count value, but the replacement cards have identifying markings that differentiate replacement cards from standard spades, hearts, diamonds and clubs suits;

placing at least one wager on the underlying card game;

optionally placing a wager on the auxiliary card game;

dealing a first number of cards to a player;

dealing cards as needed in the play of the player's hand, in common cards, the dealer's hand or combinations thereof to complete the underlying card game;

displaying all of the player's cards;

wherein if at least one of the displayed player's cards is a replacement card, paying a player who has placed the optional wager for the presence of the at least one replacement card in either the player's hand or the dealer's hand; and paying a player according to the rules of the underlying game, wherein at least some of the replacement cards have a count value of seven.

14. A method of providing a wagering game over at least two time periods comprising:

playing over a first time period a casino table wagering game using symbols in the play of the wagering game wherein a first payout table is used with a payout bonus provided for players having at least one specially marked symbol that displays standard count value in the casino table wagering game, the first time period using a first number of specially marked symbols in the play of the game, and subsequently to playing the table wagering game over the first time period, playing the casino table wagering game over a second time period with a second number of specially marked symbols that display standard count value in the play of the game, the second number being different from the first number.

15. The method of claim 14 wherein the wagering game is a card game.

16. The method of claim 15 wherein the wagering game is a variant of Twenty-one.

17. The method of claim 16 wherein after expiration of the second time period, a third time period of play occurs in which the number of specially marked symbols is larger in the third time period then in the second time period and the first time period.

18. A method of providing a wagering game over at least two time periods comprising:

playing over a first time period a casino table wagering game using symbols in the play of the wagering game wherein a first payout table is used with a bonus provided for players having at least one specially marked symbol that displays standard count value in the casino table wagering game, the first time period using a first number of specially marked symbols in the play of the game, and subsequently to playing the table wagering game over the first time period, playing the casino table wagering same over a second time period with a second number of specially marked symbols that display standard count value in the play of the game, the second number being different from the first number, wherein over the second time period, at least one payout for the presence of at least one specially marked symbol in a hand is different for the payout for the presence of at least one specially marked symbol in a hand in the first time period.

19. The method of claim 18 wherein after expiration of the second time period, a third time period of play occurs in which the number of specially marked symbols is larger in the third time period then in the second time period and the first time period.

20. A method of providing a wagering game over at least two time periods comprising:

playing over a first time period a casino table wagering game using symbols in the play of the wagering game wherein a first payout table is used with a bonus provided for players having at least one specially marked symbol that displays standard count value in the casino table wagering game, the first time period using a first number of specially marked symbols in the play of the game, and subsequently to playing the table wagering game over the first time period, playing the casino table wagering game over a second time period with a second number of specially marked symbols that display standard count value in the play of the game, the second number being different from the first number, wherein paytables used for the bonus in the first time period and the second time period are different.

21. The method of claim 20 wherein at least a highest payout in the paytable for the first time period and second the second time period are the same while other payouts in the paytable for the first time period and second the second time period are different.

22. The method of claim 21 wherein the at least one specially marked symbol that displays standard count value in the casino table wagering game consists of some but not all cards having a count value of seven.

23. The method of claim 21 wherein after expiration of the second time period, a third time period of play occurs in which the number of specially marked symbols is larger in the third time period then in the second time period and the first time period.

24. The method of claim 20 where a lowest payout in paytables for the first time period and second the second time period are lower in the time period where a greater number of specially marked symbols are present.

25. The method of claim 24 wherein the at least one specially marked symbol that displays standard count value in the casino table wagering game consists of some but not all cards having a count value of seven.

26. The method of claim 24 wherein after expiration of the second time period, a third time period of play occurs in which the number of specially marked symbols is larger in the third time period then in the second time period and the first time period.

27. A method of providing a wagering game over at least two time periods comprising:

playing over a first time period a casino table wagering game using symbols in the play of the wagering game wherein a first payout table is used with a bonus provided for players having at least one specially marked symbol that displays standard count value in the casino table wagering game, the first time period using a first number of specially marked symbols in the play of the game, and subsequently to playing the table wagering game over the first time period, playing the casino table wagering game over a second time period with a second number of specially marked symbols that display standard count value in the play of the game, the second number being different from the first number, wherein the game is a card game variant of Twenty-One and at least one specially marked symbol that displays standard count value in the casino table wagering game comprises at least some cards with a count value of seven or less.

28. A method of providing a wagering game over at least two time periods comprising:

playing over a first time period a casino table wagering game using symbols in the play of the wagering game wherein a first payout table is used with a bonus provided for players having at least one specially marked symbol that displays standard count value in the casino table wagering game, the first time period using a first number of specially marked symbols in the play of the game, and subsequently to playing the table wagering game over the first time period, playing the casino table wagering game over a second time period with a second number of specially marked symbols that display standard count value in the play of the game, the second number being different from the first number, wherein the name is a card game variant of Twenty-One and at least one specially marked symbol that displays standard count value in the casino table wagering game consists of some but not all cards having a count value of seven.

* * * * *